US007121333B2

(12) United States Patent
Wang

(10) Patent No.: US 7,121,333 B2
(45) Date of Patent: Oct. 17, 2006

(54) RADIATOR SHEET

(76) Inventor: Dong-Mau Wang, P.O. Box No. 6-57, Junghe, Tiapei 235 (TW)

( * ) Notice: Subject to any disclaimer, the term of this patent is extended or adjusted under 35 U.S.C. 154(b) by 0 days.

(21) Appl. No.: 11/024,719

(22) Filed: Dec. 30, 2004

(65) Prior Publication Data

US 2006/0144580 A1 Jul. 6, 2006

(51) Int. Cl.

| | |
|---|---|
| ***F28F 1/30*** | (2006.01) |
| ***F28F 1/20*** | (2006.01) |
| ***F28D 1/04*** | (2006.01) |
| ***F28D 15/00*** | (2006.01) |

(52) U.S. Cl. ..... 165/182; 165/181; 165/151; 165/104.21; 165/104.33; 165/185; 165/80.3; 165/80.4; 361/697; 361/699; 361/700; 361/703; 361/704; 257/714; 257/715; 257/716

(58) Field of Classification Search ..... 165/104.21, 165/104.33, 185, 80.3, 80.4, 182, 181, 151; 361/697, 699, 700, 703, 704; 257/714–716
See application file for complete search history.

(56) References Cited

U.S. PATENT DOCUMENTS

| | | | | |
|---|---|---|---|---|
| 4,928,756 | A * | 5/1990 | Shull et al. | 165/182 |
| 5,509,465 | A * | 4/1996 | Lai | 165/80.3 |
| 6,006,827 | A * | 12/1999 | Lu | 165/182 |
| 6,382,307 | B1 * | 5/2002 | Wang et al. | 165/80.3 |
| 6,435,266 | B1 * | 8/2002 | Wu | 165/80.3 |
| 6,550,529 | B1 * | 4/2003 | Horng et al. | 165/80.3 |
| 6,640,888 | B1 * | 11/2003 | Horng et al. | 165/185 |
| 6,955,214 | B1 * | 10/2005 | Wang | 165/104.33 |
| 2003/0094273 | A1 * | 5/2003 | Toth et al. | 165/183 |
| 2005/0066487 | A1 * | 3/2005 | Zhang | 24/457 |
| 2005/0073811 | A1 * | 4/2005 | Wang et al. | 361/688 |

* cited by examiner

*Primary Examiner*—John K. Ford

(57) ABSTRACT

The present invention relates to a radiator sheet improvement and more particularly to a structure with enhanced strength and increased heat exchange surface after assembling, which is achieved first by forming large holes and adjacent small holes on each radiator sheet, wherein a radiator tube passing through each large hole and a solder rod or tin solder inserted into each small hole, and then by using heat to melt solder to fill the space between the radiator sheet and the radiator tube, thereby enabling a firm bonding effect therebetween.

4 Claims, 4 Drawing Sheets

RADIATOR SHEET

BACKGROUND OF THE INVENTION (a) Field of the Invention

The present invention relates to an improvement of a radiator sheet structure and more particularly for applying heat to melt solders flowing into a gap between the radiator sheet and the radiator tube, thereby increasing heat exchange surface area, which enhances heat exchange efficiency, and enabling radiator tubes firmly connecting to radiator sheets.

(b) Description of the Prior Art

Heat emitting can always be the core issue in today's 3C products. A conventional heat exchange device is to use, besides a fan, copper or aluminum corrugated radiator sheets and an increase of heat exchange surface can be achieved through increasing of stacked radiator sheets.

With inadequacy in heat exchange capability when using only corrugated radiator sheets, an improvement was made by adding radiator tubes on each radiator sheet. As such, the area of the connection surface therebetween, which allows heat conducting from radiator sheets to radiator tubes, is vital to heat exchange efficiency.

Referring to FIG. 1. A conventional radiator sheet A includes a large hole A1, a small hole A2, a radiator tube 20, and a solder wire 30, wherein the small hole A2 formed adjoining the large hole A1, the radiator tube 20 formed in the large hole A1, and the solder wire 30 formed in the small hole A2. By using heat to melt the solder wire 30, the radiator sheet A thereby bonds the radiator tube 20.

As the solder wire 30 melting, liquid solder will be flowing down to fill only part of the space between the outer perimeter of the radiator tube 20 and the inner perimeter of the large hole A1, thereby causing a less stable bonding effect. Furthermore, creaks on the solder-filled space may occur when imposing an external force, which further reduces heat conductivity therebetween.

SUMMARY OF THE INVENTION

The present invention relates to a radiator sheet improvement and more particularly to a structure with enhanced strength and increased heat exchange surface after assembling, which is achieved first by forming large holes and small holes adjoining thereof on each radiator sheet, wherein a radiator tube passing through each large hole and a solder rod or tin solder inserted into each small hole, and then by using heat to melt solder to fill the space between the radiator sheet and the radiator tube, thereby enabling a firm bond therebetween.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
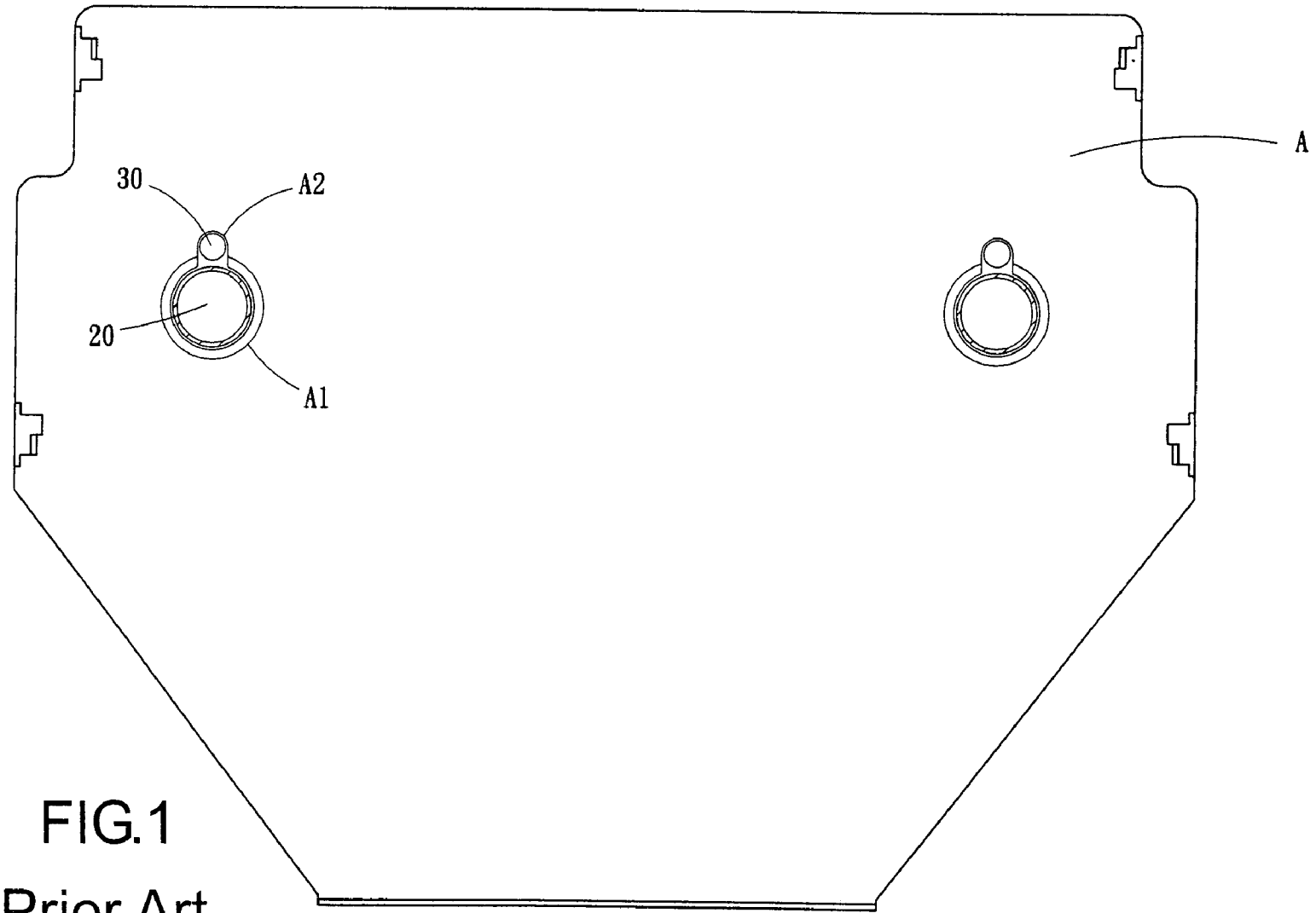
FIG.1 Prior Art
FIG. 1 shows a perspective view of a conventional product.
Figure 2:
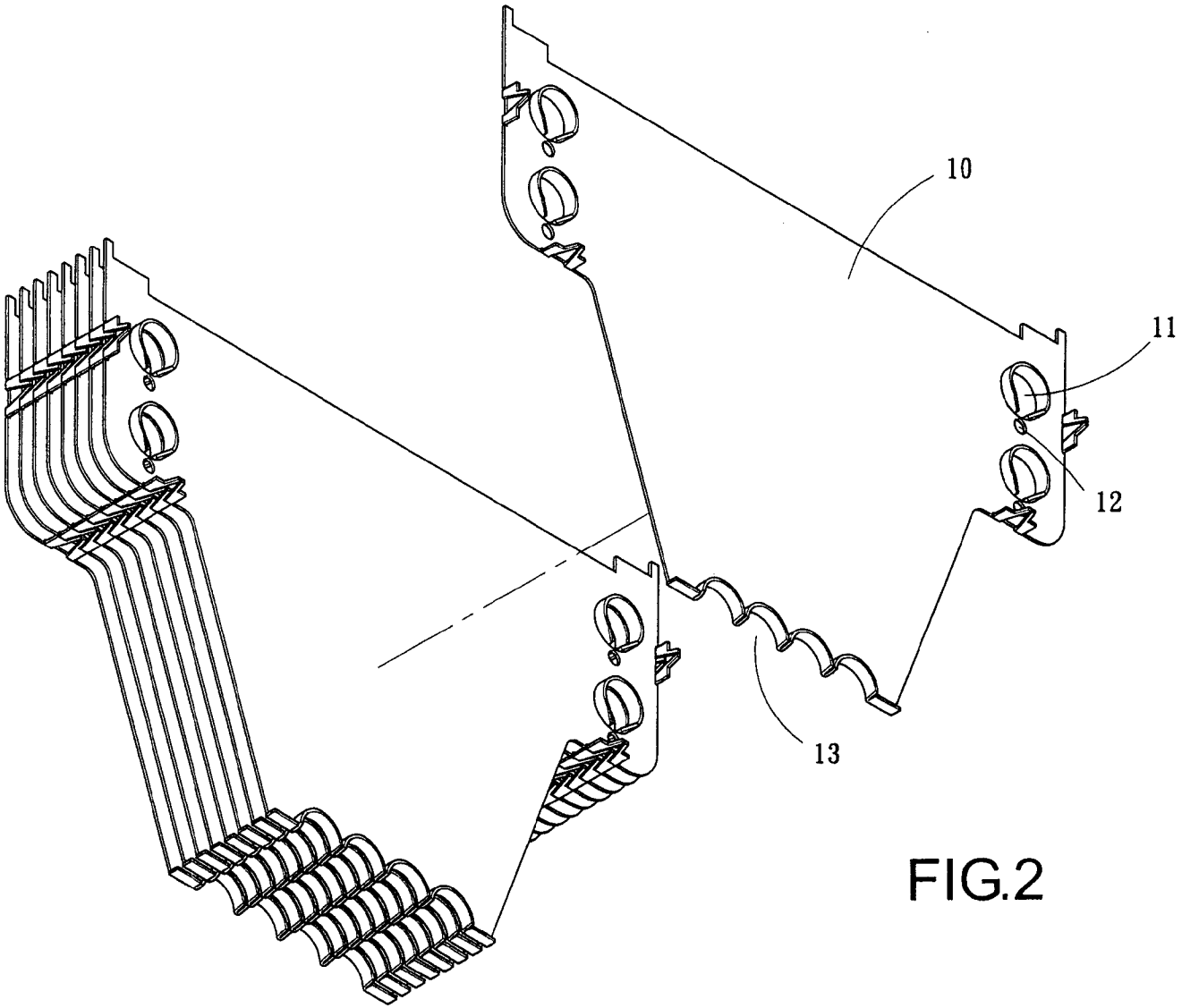
FIG. 2 shows an exploded elevational view of the present invention.
Figure 3:
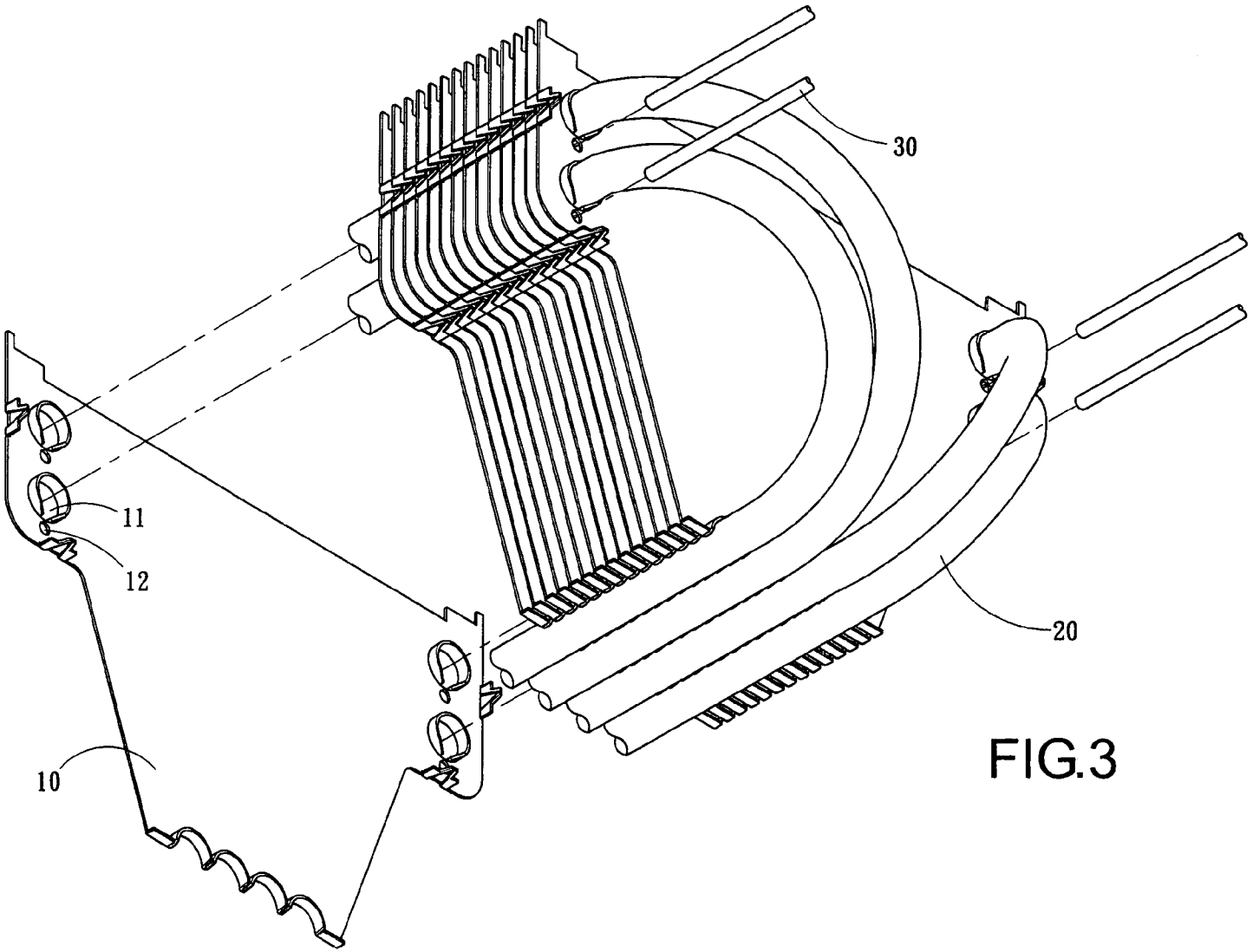
FIG. 3 shows an exploded elevational view of the present invention when in assembly.
Figure 4:
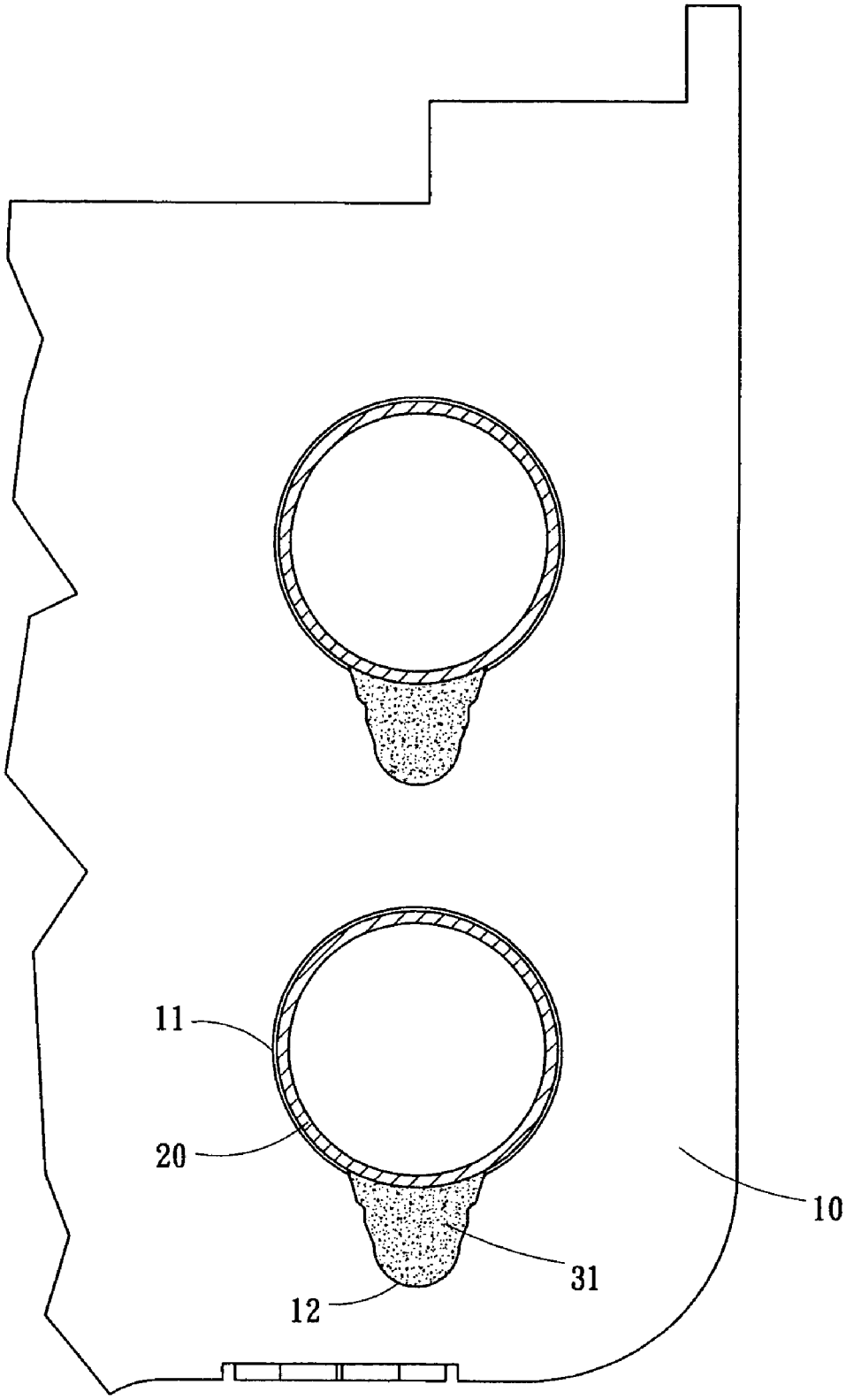
FIG. 4 shows a cross sectional view of the present invention.

Referring to FIGS. 2 and 3. The present invention relates to a radiator sheet improvement including radiator sheets 10, large holes 11, small holes 12, radiator tubes 20, solder rods 30, and semi-circle grooves 13, wherein large holes 11 formed on each radiator sheet, a small hole 12 formed adjoining each large hole 11 with a measurable gap, a radiator tube 20 formed in each large hole 11, a solder rod 30 formed in each small hole 12, and grooves 13 with the same diameter and quantity as those of large holes 11 formed on an end of each radiator sheet 10.

By applying heat to melt solder rods 30, liquid solder 31 will then flow to enclose the outer perimeter of the radiator tube 20 and also to stick to surfaces of the radiator sheet 10 on the rim of the large hole 11 as well as between the large hole 11 and the small hole 12, thereby increasing contacting surfaces between the radiator sheet 10 and the radiator tube 20 and enhancing heat conducting efficiency therebetween.

Furthermore, with the design of grooves 13 and with one end of the radiator tube 20 already fixed in the large hole 11, the other end thereof can then be inserted in each groove 13, thereby enabling the radiator tube 20 fixing in the radiator sheet 10.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A radiator sheet assembly comprising:

a) a plurality of radiator sheets, each sheet of the plurality of radiator sheets having:

i) a plurality of first holes located on a top portion thereof;

ii) a plurality of second holes, each of the plurality of second holes having a diameter smaller than a diameter of the plurality of first holes; one of the plurality of second holes being located below and spaced apart a predetermined distance from each of the plurality of first holes; and iii) a plurality of semi-circular grooves located on an edge of a bottom portion thereof;

b) a plurality of radiator tubes connected to the plurality of radiator sheets, a first end of one of the plurality of radiator tubes being inserted into each of the plurality of first holes, and a second end of one of the plurality of radiator tubes being inserted into each of the plurality of semi-circular grooves; and c) a plurality of solder rods, one of the plurality of solder rods being inserted into each of the plurality of second holes below the first end of one of the plurality of radiator tubes.

2. The radiator sheet assembly according to claim 1, wherein the plurality of solder rods are made of material having a melting point lower than the plurality of radiator sheets and the plurality of radiator tubes.

3. The radiator sheet assembly according to claim 1, wherein the plurality of radiator tubes are connected to the plurality of first holes of the plurality of radiator sheets by melted solder from the plurality of solder rods.

4. The radiator sheet assembly according to claim 1, wherein each first hole of the plurality of first holes has a lip protruding outwardly from a periphery thereof, each lip having a gap located adjacent to one of the plurality of second holes.

* * * * *